US008302734B2

(12) United States Patent
Krock

(10) Patent No.: US 8,302,734 B2
(45) Date of Patent: Nov. 6, 2012

(54) HINGED DOCKING PLATFORM

(75) Inventor: Donald F. Krock, Windgap, PA (US)

(73) Assignee: T-Mobile USA, Inc., Bellevue, WA (US)

( * ) Notice: Subject to any disclaimer, the term of this patent is extended or adjusted under 35 U.S.C. 154(b) by 446 days.

(21) Appl. No.: 12/499,261

(22) Filed: Jul. 8, 2009

(65) Prior Publication Data

US 2011/0005862 A1 Jan. 13, 2011

(51) Int. Cl.
*E06C 7/16* (2006.01)
*E04G 5/10* (2006.01)

(52) U.S. Cl. ..... 182/84; 182/113

(58) Field of Classification Search ..... 182/84, 182/113

See application file for complete search history.

(56) References Cited

U.S. PATENT DOCUMENTS 5,625,363 A * 4/1997 Spilker ..... 342/352
7,396,064 B2 * 7/2008 Hicks ..... 296/26.01
7,410,205 B2 * 8/2008 Cardwell et al. ..... 296/162
7,686,381 B1 * 3/2010 Leonard ..... 296/162
2009/0200108 A1 * 8/2009 Rathbone et al. ..... 182/84

* cited by examiner

*Primary Examiner* — Alvin Chin Shue
(74) *Attorney, Agent, or Firm* — Lee & Hayes, PLLC

(57) ABSTRACT

A hinged docking platform may include a base having a planar surface configured to support a user while suspended adjacent to an elevated unit. The base may be coupled to an elevated unit via a hinge. The hinge may enable a rotational transition of the base between a substantially vertical orientation of the planar surface as a closed position and a substantially horizontal orientation of the planar surface as an open position. The base may also include a guard rail extending around at least a portion of a perimeter of the base where the guard rail protrudes above the base when the base is in the open position. In some aspects, a ladder may be coupled to the base to enable access to the base when the base is oriented in the open position. In further aspects, a biasing component may be coupled between the elevated component and the base to bias the base during the rotational transition between the closed position and the open position.

12 Claims, 7 Drawing Sheets

HINGED DOCKING PLATFORM

BACKGROUND

Many buildings include mechanical and electrical units located in elevated locations, such as on rooftops or on sides of building. For example, a large commercial building may include a number of heating, ventilation, and air conditioning (HVAC) units, communication units, or other mechanical/electrical units that are located on the exterior of the building. These units often include access panels that enable workers to perform installations, upgrades, maintenance, or other work on an interior of the unit. In some instances, the access panels are elevated above the ground or a floor (rooftop, etc.) and difficult to reach without additional tools or supplies.

In some locations, elevated units may be located within a close proximity to one another leaving little or no additional room for fixed elevated platforms that may be used to access the units. As a result, workers often have to supply a portable ladder to access the units. In some instances, the workers may have to carry the ladders to the location of the unit, such as from the worker's vehicle, which may be time consuming and difficult.

Mechanical/electrical units may be expensive. Often these units include latched access panels to prevent unwanted access to the units. However, the access panels have limited ability to prevent unwanted access to the units.

SUMMARY

A hinged docking platform may include a base having a planar surface configured to support a user while suspended adjacent to an elevated unit. The base may be coupled to an elevated unit via a hinge. The hinge may enable a rotational transition of the base between a substantially vertical orientation of the planar surface as a closed position and a substantially horizontal orientation of the planar surface as an open position.

In some aspects, the base may include a guard rail, ladder, and biasing component. The guard rails may extend around a portion of a perimeter of the base where the guard rail protrudes above the base when the base is in the open position. A ladder may be coupled to the base to enable access to the base when the base is oriented in the open position. A biasing component may be coupled between the elevated component and the base to bias the base during the rotational transition between the closed position and the open position.

In further aspects, the base may cover an access aperture of the elevated unit when the base is in the closed position. The base may be locked in the closed position to prevent unwanted access to the access aperture. The base may also include a folding leg, a folding ladder, and folding guard rails that lay flat against the base when the base is in the closed position.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Overview

As discussed above, workers may use portable ladders to gain access to an elevated unit. Work may be performed on or in the elevated unit such as installations, upgrades, maintenance, or other work. A hinged docking platform is disclosed to provide workers convenient access to an elevated unit without a need for additional tools or supplies, such as a portable ladder. The hinged docking platform may be coupled to the elevated unit (e.g., the elevated unit's base, etc.). In accordance with various embodiments, the hinged docking platform may be rotated from an open position that can support a worker to a closed (stored, retracted) position proximate an access panel to free up (or otherwise make available) space around the elevated unit. The hinged docking platform may be locked in the closed position to prevent unwanted access to the elevated unit.

When a worker desires to use the platform, the worker may lower the platform, via a pull cord, lever, or other lowering device. In some embodiments, the hinged docking platform may include a selection of a ladder, support legs and/or tension supports, guard rails, and a biasing device.

The hinged docking platform described herein may be implemented in a number of ways. Example implementations are provided below with reference to the following figures.

Illustrative Embodiments

Figure 1:
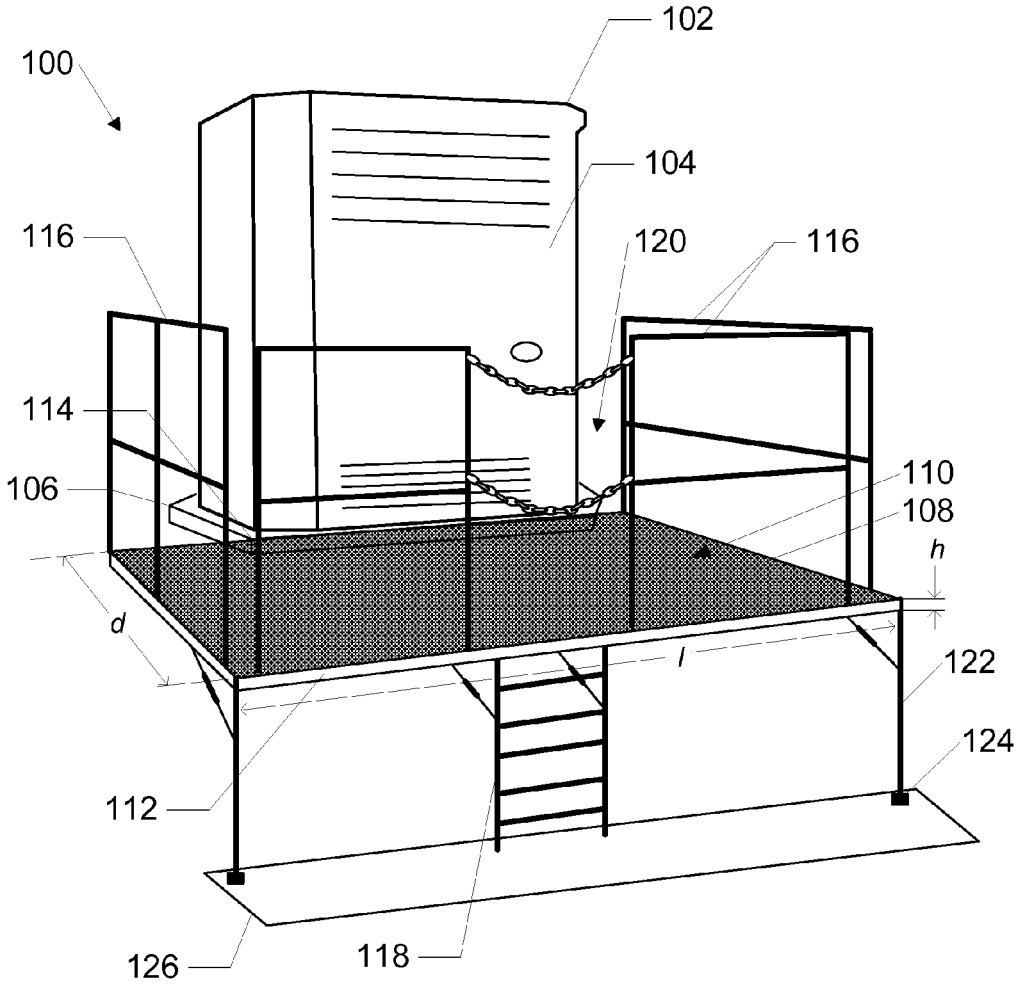
FIG. 1 is an isometric view of an illustrative hinged docking platform with a base oriented in an open position.

FIG. 1 is an isometric view of an illustrative hinged docking platform 100 (or simply "platform") that may support a worker while performing work on an elevated unit 102 (or simply "unit"). The unit 102 may be any mechanical, electrical, and/or electromechanical, or combination thereof, device that is located in an elevated operating position. For example, the unit 102 may be located up to eight feet or more above the rooftop of a building. The unit 102 may include an access panel 104 to enable a worker to gain access to an interior of the unit 102. In addition, the unit 102 may include a support 106, which may be defined by the bottom of the unit, an additional structure coupled to the bottom of the unit, a pedestal, or the like.

As shown in FIG. 1, a base 108 of the hinged docking platform 100 may be oriented in an open position to enable the platform 100, via the base 108, to support the worker proximate the unit 102. The base 108 may include a planar surface 110 and sides 112, where the planar surface 110 is defined by a length (l) and a depth (d) and the sides 112 are defined by a height (h) and one of the length (l) or the depth (d). In some embodiments, the base 108 may be formed as a grating to reduce weight, improve friction applied between a worker's shoes and the base, enable water (rain) to freely pass through the base, or for other advantageous reasons. The base 108 may be formed of any substantially rigid material, or material having an integrated rigid structure, such as and without limitation aluminum (or other metals), polymer-based materials, carbon fiber, rubber, or wood. In some embodiments, the base 108 may be grounded to prevent an electrical shock when a user engages the unit 102 from the base.

In accordance with one or more embodiments, the base 108 may be coupled to the elevated unit 102 via a hinge 114. The hinge 114 may be coupled between one of the sides 112 of the base 108 and the support 106 of the elevated unit 102. In this way, the hinge 114 may enable rotation of the base 108 between a substantially vertical orientation of the planar surface 110 as a closed position and a substantially horizontal orientation of the planar surface 110 as an open position. The hinge 114 may be implemented by a cylindrical hinge, pivoting levers, or other structures that enable rotation of the base 108 with respect to the unit 102.

One or more guard rails 116 (i.e., hand rails) may be coupled to the base 108 to provide a lateral structure around the perimeter of the base when the base is in the open position. The guard rails 116 may be configured to prevent a worker from moving beyond edges defined by the sides 112 of the base 108, and thus possibly falling from the platform 100. The guard rails 116 may also be used as hand rails and/or provide additional structural (stiffening) support to the base 108.

In some embodiments, the platform 100 may be accessible via an access component 118. Although the access component 118 shown in FIG. 1 resembles a ladder, it is contemplated that other devices may be used to enable a worker to access the platform such as stairs, a ramp, a dumbwaiter, and so forth. In some embodiments, the guard rails 116 may define an access point 120 at the top of the access component 118 to enable the worker to gain access to the base 108 when the guard rails 116 are engaged in an upright projecting position. The access point 120 may be "closed" via use of a door, chains, or another access restraint.

In various embodiments, the base 108 may be supported in the substantially horizontal orientation of the planar surface 110 (open position) by a support structure. As shown in FIG. 1, the support structure may be configured as one or more legs 122 that are in compression to support the base 108. The legs 122 may engage the ground (e.g., roof, etc.) or the elevated unit 102 (e.g., via the support 106, etc.) to support the platform 100. The legs 122 may include feet 124 to increase a surface area of contact with the ground or the elevated unit 102.

In addition or an alternative, the access component 118 (e.g., ladder) may act as a support structure. The support structure may also be implemented using cables, chains, etc., that are in tension to support the base 108 via a connection to the elevated unit 102 or another structure located above the hinge 114.

In some embodiments, a sub-platform 126 may be situated proximate the ground. The sub-platform 126 may act as a land-bridge to prevent the worker (or other people) from touching conduits, cables, or other important features on the ground (e.g., roof). The sub-platform 126 may include one or more features that engage the legs 122 and/or the access component 118 to secure the same when the platform 100 is in the open position.

Figure 2:
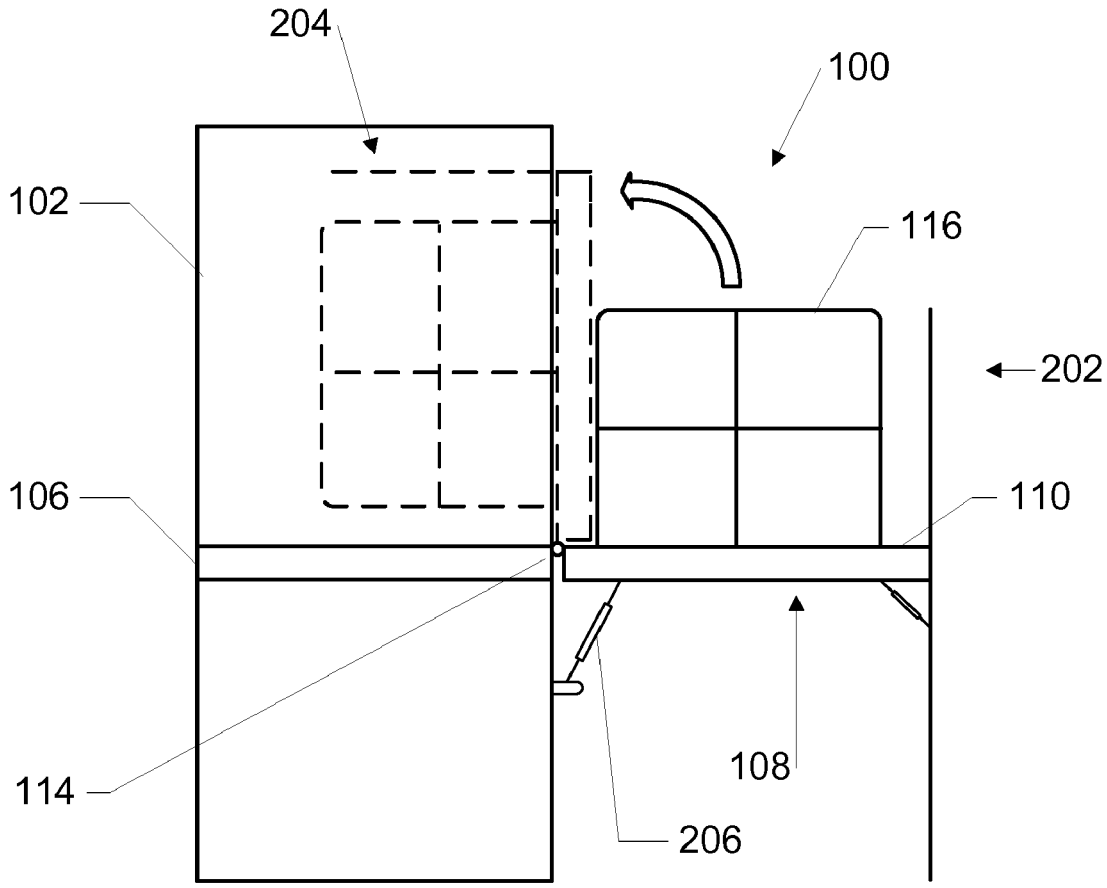
FIG. 2 is a side elevation view of an illustrative rotation of the platform of FIG. 1 between the open position and a closed position.

FIG. 2 is a side elevation view of an illustrative rotation of the platform 100 of FIG. 1 between an open position and a closed position. In accordance with various embodiments, the hinge 114 enables rotation (transition) of the base 108 between a substantially horizontal orientation of the planar surface 110 as an open position 202 and a substantially vertical orientation of the planar surface 110 as a closed position 204 (shown in dashed lines in FIG. 2).

The platform 100 may include a biasing device 206 to assist in the transition between the open position 202 and the closed position 204. The biasing device 206 may operate as a dampener when the platform 100 is lowered from the closed position 204 to the open position 202. In this instance, the biasing device 206 may decrease a rate of the transition as compared to the transition conducted without the biasing device (e.g., resist the downward force from gravity). The biasing device 206 may assist in retracting the platform 100 from the open position 202 to the closed position 204. In this instance, the biasing device 206 may reduce a force necessary for the worker (or motor, etc.) to transition the platform 100 to the closed position 204. In some embodiments, the biasing device 206 may be implemented as a gas shock.

Figure 3:
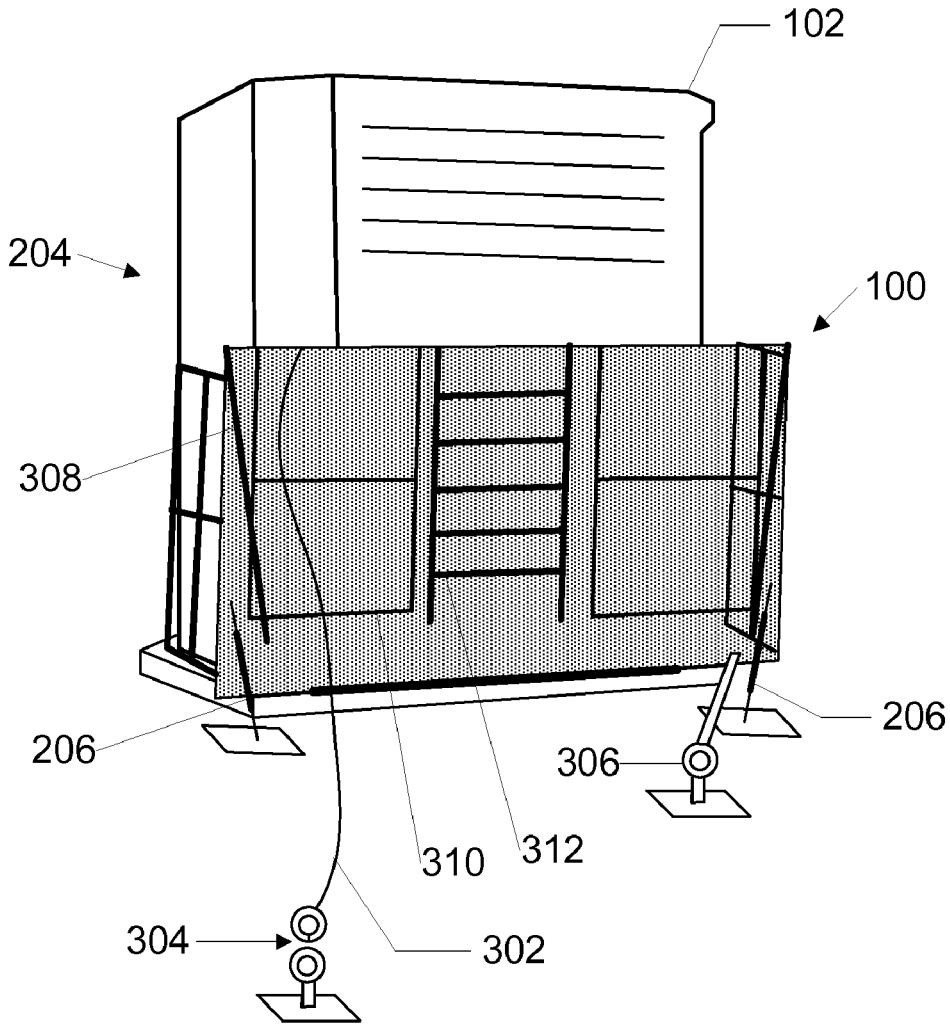
FIG. 3 is an isometric view of an illustrative hinged docking platform with a base oriented in a closed position.

FIG. 3 is another isometric view of the illustrative hinged docking platform 100. As shown in FIG. 3, the platform 100 is oriented in the closed position 204. The platform 100 may include the biasing device 206 to assist in the transition of the platform from the open position 202 to the closed position 204, or vice versa.

In accordance with some embodiments, the platform 100 may include a transition device 302 to enable a worker to transition the platform 100 between the open position 202 and the closed position 204. For example and without limitation, the transition device 302 may be a cord, cable, lever, or handle that may enable a user to pull the platform 100 from the closed position 204 to the open position 202. In such an instance, the biasing device 206 may present a resistance force opposite a downward force applied by the worker and/or gravity, and thus slow the transition of the platform. Once the platform 100 is in the open position, an engagement lock 304 may be activated to maintain the platform 100 in the open position 202. The engagement lock 304 may be integrated with the transition device 302. For example, a pull cable may include a loop at the end opposite the base 108 that secures to a tie-down (near the ground) to place the cable in tension, and thus prevent the platform from retracting to the closed position 204.

In various embodiments, the platform 100 may include a locking mechanism 306 to lock the platform in the closed position 204. The locking mechanism 306 may prevent unwanted access or use of the platform 100 by securing the platform in the closed position to exclude access to the unit 102 by undesignated people. The locking mechanism 306 may be accessible by a worker without the use of a ladder. In some embodiments, the locking mechanism 306 may be implemented as a lever that is accessible to a worker that is situated on the ground (e.g., within arms reach). A first side of the lever may engage the platform and a second end of the lever may be accessible by a worker on the ground and be capable of being secured by the locking mechanism 306 to prevent movement of the platform 100.

As shown in FIG. 3, the platform 100 may include storable items including storable legs 308, storable guard rails 310, and/or a storable ladder 312. The storable items may be coupled to the base 108 via a hinge that enables rotation of the legs, guard rails, and/or ladder to assume a substantially parallel longitudinal orientation with respect to the planar surface 110 of the base 108. Accordingly, when the platform 100 is in the closed position 204, the storable legs 308, the storable guard rails 310, and/or the ladder 312 may be in a stored position and not extending outward (perpendicular) from the planar surface 110. This may make space proximate the unit 102 available for other uses when the unit is in the closed position 204.

Additional Embodiments

Figure 4:
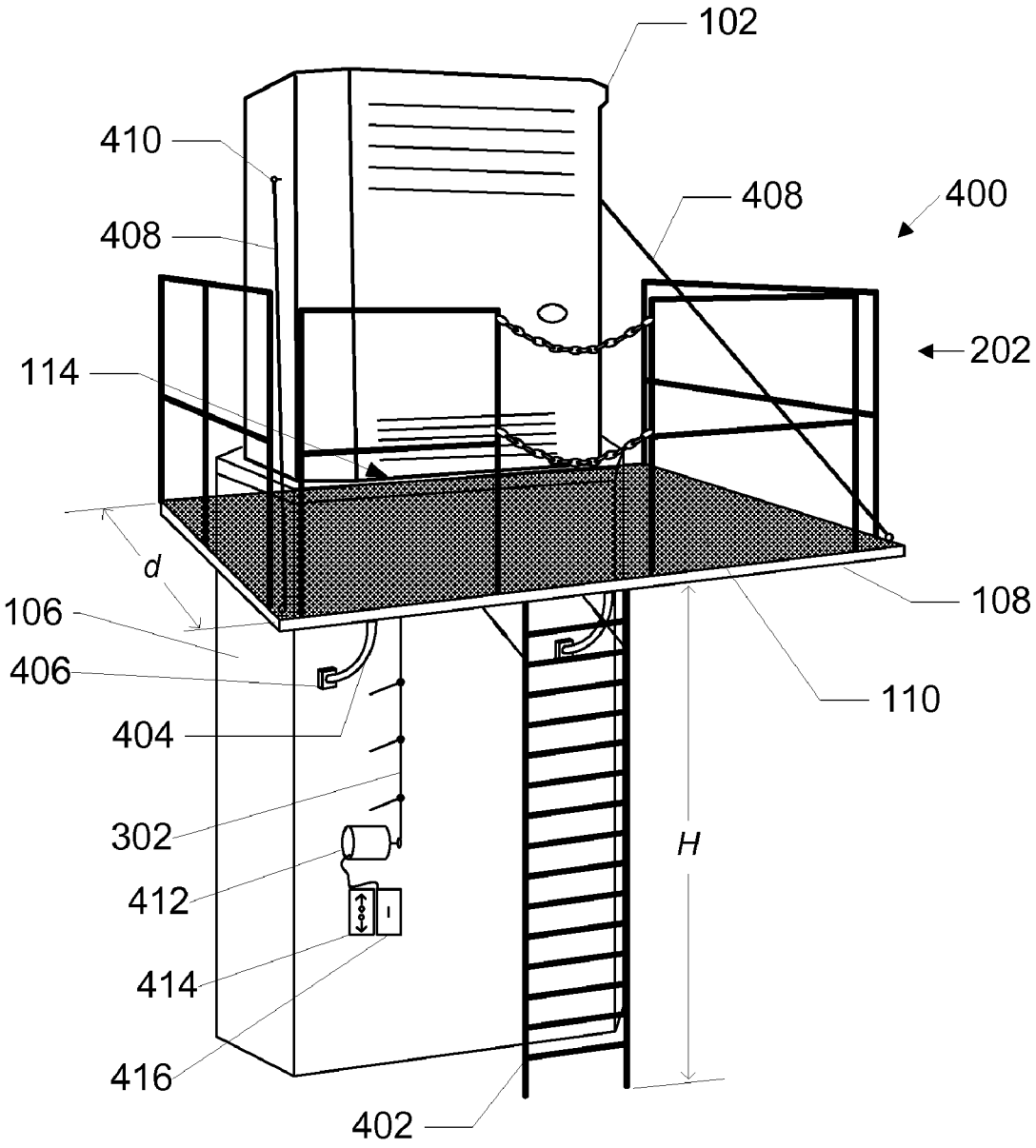
FIG. 4 is an isometric view of an illustrative hinged docking platform with an extendable ladder and a base oriented in an open position.

FIG. 4 is an isometric view of another illustrative hinged docking platform 400 oriented in an open position. The platform 400 includes a ladder 402 that is coupled to the base 108. The ladder 402 may longer than a depth (d) defined by a base 108.

In accordance with some embodiments, the platform 400 may include legs 404 that engage the support 106 of the elevated unit 102. The legs 404 may be curved/angled to enable a planar surface 110 of the base 108 to be oriented in a substantially horizontal orientation (when the platform is in the open position 202) when the legs 122 engage the support 106. Each of the legs 404 may include a foot 406 to increase the surface area in contact with the support 106, and thus distribute a force exerted on the support over a greater surface area.

In some embodiments, the platform 400 may be supported in the open position 202 via tension supports 408. The tension supports 408 may include without limitations, cables, cords, chains, or brackets that extend between the platform 400 (e.g., the base 108) and an attachment point 410 on the elevated unit 102 (or support 106) that is located above the hinge 114.

The platform 400 may include a height (H) that is measured between the ground and the base 108. The height (H) may be greater than the reachable height of a worker (with arms extended upright). Thus, the worker may rely on the transition device 302 to raise/lower the platform 400 during a transition between the open position and the closed position.

In some embodiments, the transition device 302 may include a motor 412 that, when activated, may transition the platform 400 between the open position 202 and the closed position (shown in FIG. 2). The motor 412 may use a geared system to obtain a mechanical advantage during the transition period. As an example, the worker may activate (turn on) the motor 412 via a control panel 414 to lower the platform 400 to the open position 202. To prevent unwanted access to the platform 400, the control panel 414 may be deactivated via a control lock 416. To retract the platform 400, the worker may reverse the motor via the control panel 414 to transition the platform 400 to the closed position.

The ladder 402 may rotate outward and away from the elevated unit 102 and support 106 when the platform 400 is transitioned from the closed position to the open position 202. Alternatively, the latter 402 may be accessed via a second motor that selectively lowers the ladder, via a pull cord, or another suitable self-contained component of the platform 400 that enables the worker to obtain access to the ladder 402.

Figure 5:
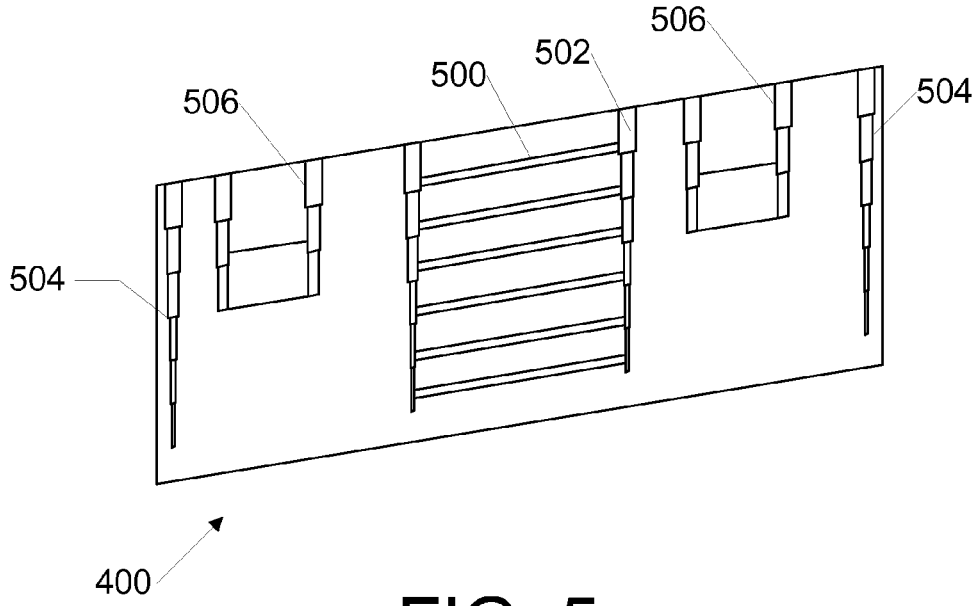
FIG. 5 is a side elevation view of an illustrative telescoping ladder coupled to the base.

FIG. 5 is a side elevation view of an illustrative telescoping ladder 500 coupled to the platform 400. The telescoping ladder 500 may enable reducing the size of the ladder (e.g., vertical height) in the stored position by compressing the ladder via telescoped sections 502 that slide into an adjacent section, and thus reduce the length of the ladder. The telescoping ladder 500 may enable convenient storage and prevent unwanted access to the ladder and the platform 400. The telescoping ladder 500 may transition from an extended state (when the platform is in the open position) to a compressed state shown in FIG. 5 (when the platform is in the closed state) via a biasing device, a motor, a lever, or by other mechanical features known in the art.

Similar to the telescoping ladder 500, the platform 400 shown in FIG. 5 may include other telescoping components such telescoping legs 504 and telescoping guard rails 506.

Figure 6:
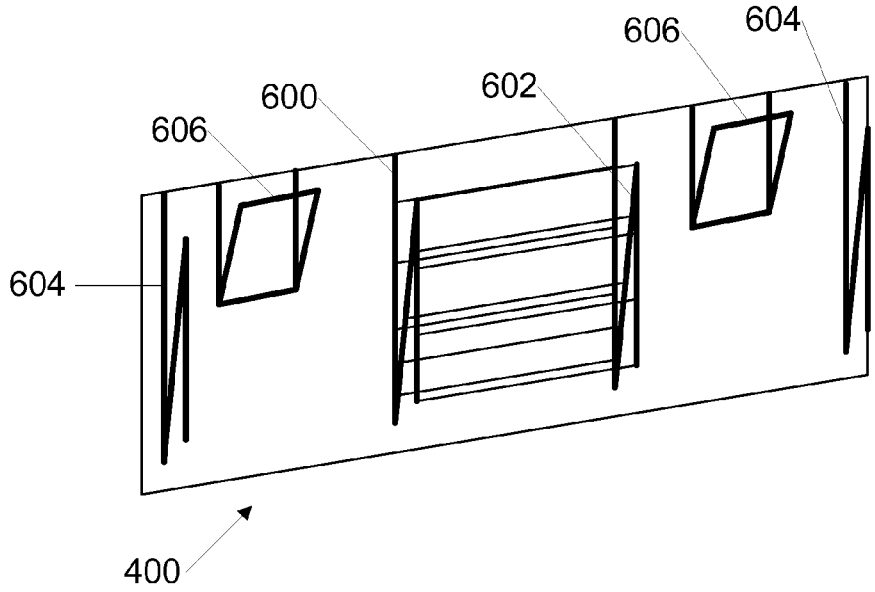
FIG. 6 is a side elevation view of an illustrative folding ladder coupled to the base.

FIG. 6 is a side elevation view of an illustrative folding ladder 600 coupled to the platform 400. The folding ladder 600 may enable reducing the size of the ladder (e.g., vertical height) in the stored position by folding the ladder via hinged sections 602 that accordion (or otherwise fold) next to an adjacent section, and thus reduce the length of the ladder. Similar to the telescoping ladder 500, the folding ladder 600 may enable convenient storage and prevent unwanted access to the ladder and the platform 400. The folding ladder 600 may transition from an extended state (when the platform is in the open position) to a compressed state (when the platform is in the closed state) via a biasing device, a motor (possible with geared sections), a lever, or by other mechanical features known in the art.

Similar to the folding ladder 600, the platform 400 shown in FIG. 6 may include other folding components such folding legs 604 and folding guard rails 606. In some embodiments, a mix of folding components and telescoping components may be utilized to reduce the storage space of the platform 400 when the platform is in the closed position.

Figure 7:
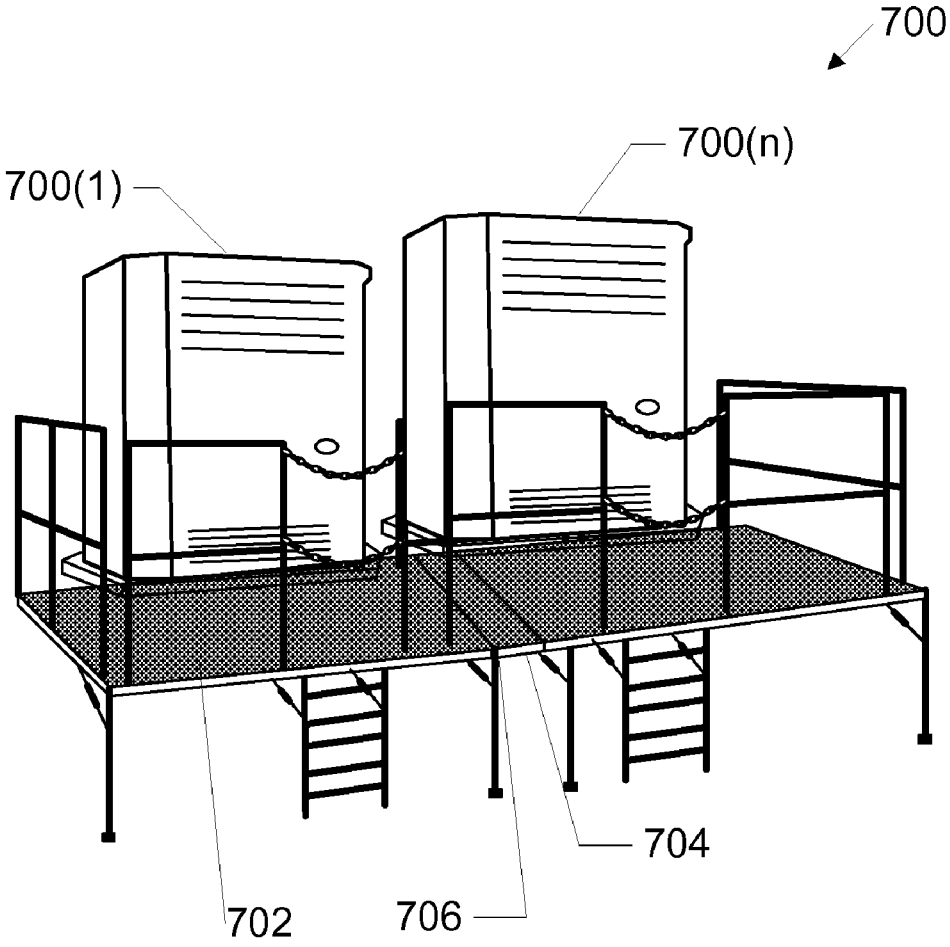
FIG. 7 is an isometric view of an illustrative hinged docking platform located adjacent another platform.

FIG. 7 is an isometric view of illustrative hinged docking platforms 700. As shown in FIG. 7, a first platform 700(1) is located adjacent another platform **700(*n*). The platforms 700 may include removable guard rails to enable access between the bases 702 of the platforms. In some embodiments, a base 702(1) may include a spacer panel 704 to span a gap defined between the first platform 700(1) and the adjacent platform 700(*n*). The spacer panel 704 may be coupled to one of the bases via a hinge 706, and thus fold against one of the bases 702 when the platform(s) are in the closed position. In some embodiments, one of the platforms 700** may be in the open position while another of the platforms is in the closed position.

Figure 8:
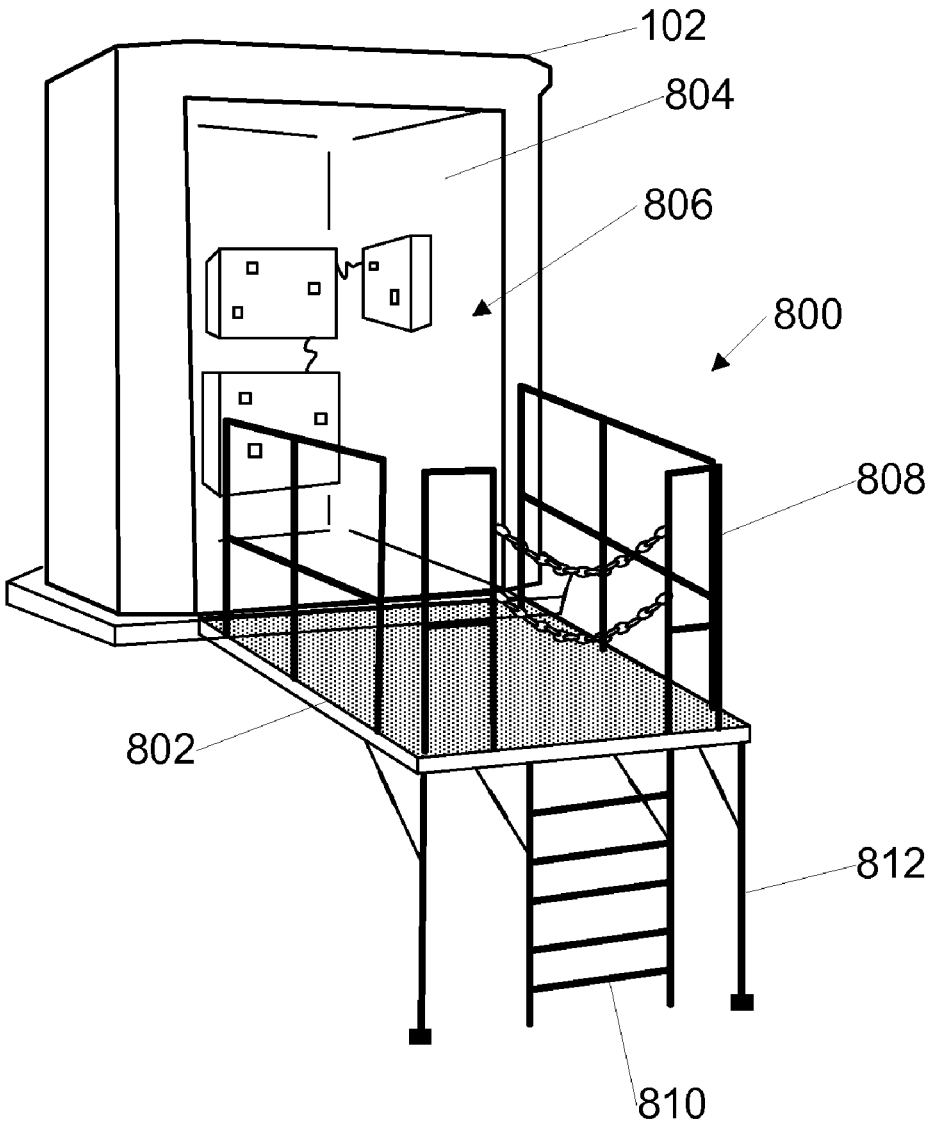
FIG. 8 is an isometric view of an illustrative hinged docking platform where the base is used as an access panel of the elevated unit.

FIG. 8 is an isometric view of an illustrative hinged docking platform 800 where a base 802 is used as an access panel of the elevated unit 102. While in the closed position, the base 802 of the platform 800 may prevent unwanted access to an interior 804 of the elevated unit by covering an aperture (entry) 806 of the elevated unit 102. The base 802 may include vents or other openings to enable a desired level of airflow between an interior of the elevated unit and the outside air.

In accordance with various embodiments, guard rails 808, an access component 810, and/or legs 812 may fold, telescope, or otherwise transition between an open position (e.g., guard rails lateral to base to restrain the worker on the base 804, the legs 812 in contact with the ground, etc.) and a closed position. In the closed position, the guard rails 808, the access component 810, and/or the legs 812 may retract proximate the base 804 to reduce a perceived storage volume of the platform similar to the platform 100 shown in the closed position in FIG. 3.

CONCLUSION

Although the techniques have been described in language specific to structural features and/or methodological acts, it is to be understood that the appended claims are not necessarily limited to the specific features or acts described. Rather, the specific features and acts are disclosed as exemplary forms of implementing such techniques.

What is claimed is:

1. A retractable platform, comprising:

an elevated rooftop telecommunications unit that securely stores telecommunications equipment in a fixed location;

a base coupled to the elevated telecommunications unit via a rotatable hinge, the base configured to transition between an open position where the base is substantially horizontal and a closed position where the base is substantial vertical wherein each side of the base extends laterally beyond each side of the telecommunications unit;

a biasing device coupled between the base and the elevated telecommunications unit to counteract gravitational forces during the transition;

an access component coupled to the base to enable user access to the base from an elevation below the elevated telecommunications unit;

a guard rail configured around the perimeter of the base, a first portion of the guard rail configured to fold against the base when the base is in the closed position and second portions of the guard rail being fixed such that the second portions do not fold against the base when the base is in the closed position; to the sides of the base extending laterally beyond each side of the telecommunications device such that the second portions extend outward and proximate each side of the telecommunications unit when the base is in the closed position causing the telecommunication unit to be situated at least partially between the second portions; and a support member coupled to the base to support the base in the open position.

2. The retractable platform as recited in claim 1, wherein the support member is a leg that folds against the base when the base is in the closed position.

3. The retractable platform as recited in claim 1, wherein the support member is a tension member coupled between the base and a point on the elevated telecommunications unit that is above the base, the tension member being one of a chain, a cord, or a cable.

4. The retractable platform as recited in claim 1, wherein the access component is a ladder that is configured to fold against the base when the base is in the closed position.

5. The retractable platform as recited in claim 1, wherein the base substantially covers an access to an interior of the elevated telecommunications unit when the base is in the closed position and the access is made available when the base is in the open position.

6. The retractable platform as recited in claim 1, wherein the base comprises an aluminum grate.

7. The retractable platform as recited in claim 1, further comprising:

a locking mechanism to secure the base in the closed position; and a transition device to enable transitioning the base between the open position and the closed position.

8. An apparatus, comprising:

an elevated telecommunications unit having an access aperture along an exterior wall to enable access to an interior of the elevated telecommunications unit; and a base coupled to the elevated telecommunications unit by a hinge, the base configured to rotatably transition between an open position where the base is substantially horizontal and a closed position where the base is substantially vertical, the base substantially aligned with a bottom of the access aperture when the base is in the open position and proximate the access aperture when the base is in the closed position, the base configured to support a user while suspended adjacent to the elevated telecommunications unit, the base to securely close the access aperture when the base is in the closed position, wherein each side of the base extends laterally beyond each side of the telecommunications unit; and a guard rail coupled to the base around the perimeter of the base, a first portion of the guard rail configured to fold against the base when the base is in the closed position and second portions of the guard rail being fixed such that the second portions do not fold against the base when the base is in the closed position, the second portions of the guard rail being coupled to the sides of the base extending laterally beyond each side of the telecommunications device such that the second portions extend outward and proximate each side of the telecommunications unit when the base is in the closed position causing the telecommunication unit to be situated at least partially between the second portions.

9. The apparatus as recited in claim 8, further comprising:

a biasing device coupled between the base and the elevated telecommunications unit to counteract gravitational forces during the transition;

a ladder coupled to the base to enable access to the base from an elevation below the elevated telecommunications unit;

a guard rail configured around the perimeter of the base, and a support member to support the base in the open position.

10. The apparatus as recited in claim 9, wherein the ladder and configured to fold against the base when the base is in the closed position.

11. The apparatus as recited in claim 8, further comprising a locking mechanism to secure the base in the closed position.

12. The apparatus as recited in claim 8, wherein the base is formed of a permeable structure to enable airflow through the base and into the elevated telecommunications unit when the base is in the closed position.

* * * * *